US006971647B2

(12) United States Patent
Jewell et al.

(10) Patent No.: US 6,971,647 B2
(45) Date of Patent: Dec. 6, 2005

(54) MEDIA REGISTRATION MECHANISM FOR IMAGE FORMING DEVICE

(75) Inventors: Robert W. Jewell, Meridian, ID (US); Craig Hopper, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 63 days.

(21) Appl. No.: 10/624,334

(22) Filed: Jul. 22, 2003

(65) Prior Publication Data

US 2005/0035538 A1 Feb. 17, 2005

(51) Int. Cl.[7] ..... B65H 9/00
(52) U.S. Cl. ..... 271/240; 271/250
(58) Field of Search ..... 271/240, 248, 271/250, 251, 65, 186; 399/395, 396; 400/579, 400/633

(56) References Cited

U.S. PATENT DOCUMENTS

| | | | | |
|---|---|---|---|---|
| 2,729,136 | A * | 1/1956 | Feick et al. | 356/430 |
| 3,902,715 | A | 9/1975 | Hubler et al. | |
| 4,266,762 | A | 5/1981 | Kramer et al. | |
| 4,335,971 | A | 6/1982 | deMey, II | |
| 4,511,242 | A * | 4/1985 | Ashbee et al. | 399/395 |
| 4,693,463 | A * | 9/1987 | Schwebel et al. | 271/236 |
| 4,930,766 | A | 6/1990 | Garavuso | |
| 5,078,384 | A * | 1/1992 | Moore | 271/228 |
| 5,167,409 | A * | 12/1992 | Higeta | 271/225 |
| 5,278,624 | A * | 1/1994 | Kamprath et al. | 399/395 |
| 5,394,222 | A | 2/1995 | Genovese | |
| 5,540,370 | A * | 7/1996 | Ring | 225/100 |
| 5,678,159 | A * | 10/1997 | Williams et al. | 399/395 |
| 5,791,644 | A | 8/1998 | Regimbal et al. | |
| 5,794,176 | A * | 8/1998 | Milillo | 702/150 |
| 6,324,377 | B2 * | 11/2001 | Ando et al. | 399/395 |
| 6,454,256 | B1 * | 9/2002 | Boguhn et al. | 271/238 |
| 6,485,010 | B1 * | 11/2002 | Lamothe | 270/52.09 |
| 6,712,356 | B2 * | 3/2004 | Daout et al. | 271/250 |
| 2003/0016970 | A1 | 1/2003 | Omata et al. | |

FOREIGN PATENT DOCUMENTS

| | | |
|---|---|---|
| EP | 0485786 A1 | 5/1992 |
| EP | 0956969 A3 | 5/2000 |
| GB | 2063830 A | 6/1981 |
| JP | 58026741 | 2/1983 |
| JP | 10053355 | 2/1998 |

OTHER PUBLICATIONS

United Kingdom Search Report for GB0415799.6 Completed on Nov. 11, 2004.

* cited by examiner

*Primary Examiner*—David H. Bollinger

(57) ABSTRACT

In one embodiment, an image forming device is provided that includes a media path configured to carry print media through the image forming device, an alignment mechanism including a plurality of alignment walls, and an image forming mechanism configured to form an image on the aligned print media received from the alignment mechanism. The alignment mechanism can be dynamically configurable to align the print media against a selected alignment wall from the plurality of alignment walls as the print media is carried along the media path.

34 Claims, 11 Drawing Sheets

MEDIA REGISTRATION MECHANISM FOR IMAGE FORMING DEVICE

BACKGROUND

In some image forming devices, media registration mechanisms have been incorporated into the media path in order to help align a sheet of print media (hereinafter referred to as "print media"). Aligning the print media helps to orient it in a consistent position for imaging or outputting.

In prior media registration mechanisms, moving belts were angled towards a registration fence to achieve media registration. When the print media came into contact with the angled belts, the print media was carried into and against the fence.

In other image forming devices, vacuum rotor technology has been used to orient the print media in a consistent position for imaging or outputting. Vacuum rotor technology uses vacuum suction cups to grab print media from one imaging station by applying a vacuum to the suction cups, swing the print media about an arc to the next imaging station, and then drop off the print media to the next imaging station.

BRIEF DESCRIPTION OF THE DRAWINGS

It will be appreciated that the illustrated boundaries of elements (e.g., boxes or groups of boxes) in the figures represent one example of the boundaries. One of ordinary skill in the art will appreciate that one element may be designed as multiple elements or that multiple elements may be designed as one element. An element shown as an internal component of another element may be implemented as an external component and vice versa.

Further, in the accompanying drawings and description that follow, like parts are indicated throughout the drawings and description with the same reference numerals, respectively. The figures are not drawn to scale and the proportions of certain parts have been exaggerated for convenience of illustration.

DESCRIPTION OF ILLUSTRATED EMBODIMENTS

Figure 1:
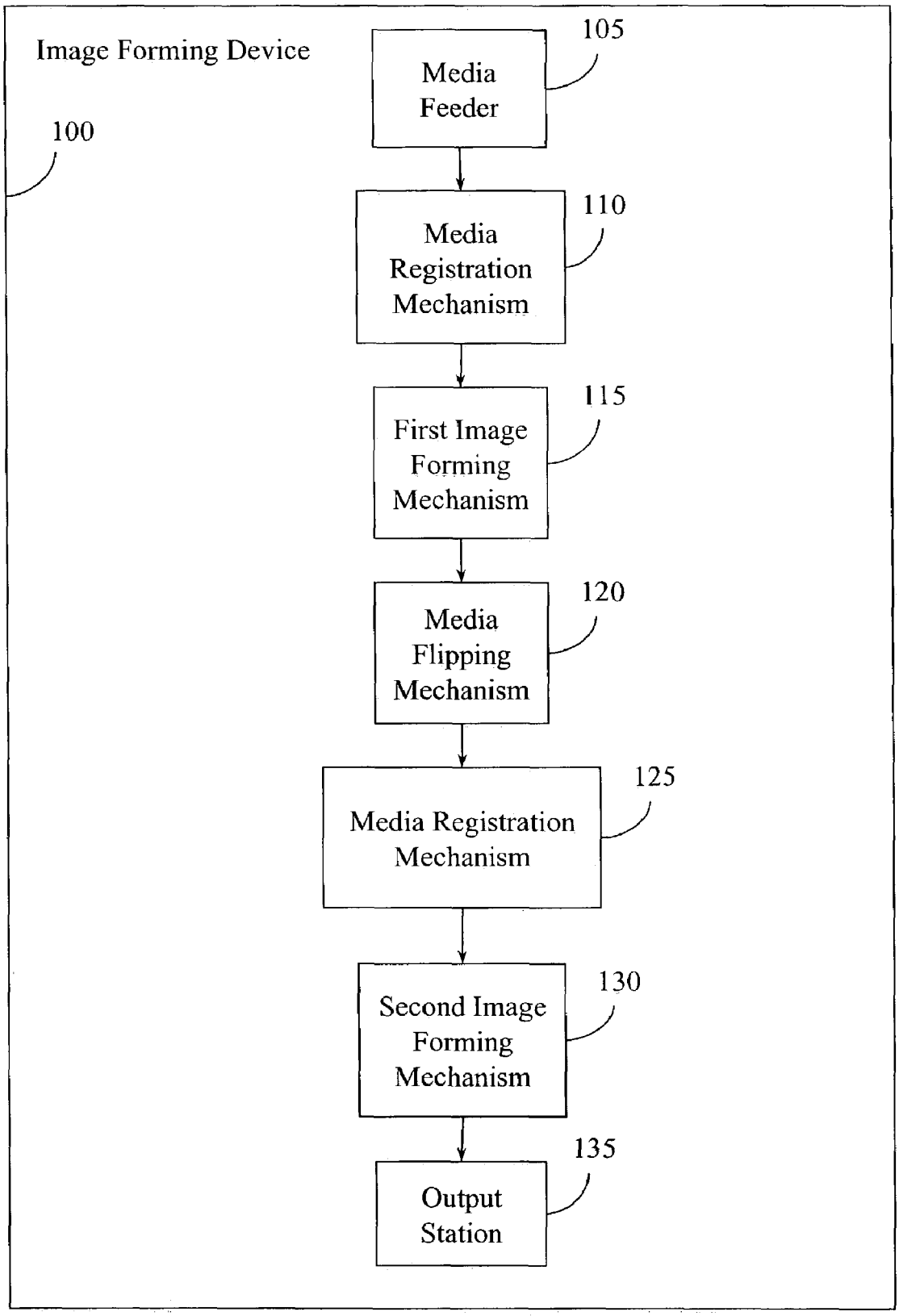
FIG. 1 is a diagram of one embodiment of an image forming device 100.

Illustrated in FIG. 1 is one embodiment of an image forming device 100. The image forming device 100 may be a printing device such as an electrophotographic printer, a laser printer, an ink-jet printer, a copier, an all-in-one product, a multifunctional peripheral (MFP) device, or other type of imaging device that forms an image onto print media. In one embodiment, the image forming device 100 may include a media handling mechanism such as a media feeder 105. The media feeder 105 can be configured to supply print media from an input position to a media registration mechanism 110 along a media path. The media registration mechanism 110 is configured to align the print media prior to imaging. In one embodiment, the media registration mechanism 110 is configured to align an edge of the print media against a registration wall so that the print media is in a relatively consistent position and orientation for imaging.

The registered print media can then be advanced to a first image forming mechanism 115 where an image may be formed onto the print media. Optionally, the print media may pass through the first image forming mechanism 115 without being imaged. The first image forming mechanism 115 may be embodied in a variety of different ways depending on the type of image forming device 100. For example, the first image forming mechanism 115 may include an electrophotographic imaging mechanism, a laser imaging mechanism, an inkjet mechanism, a thermal printing mechanism, a digital image reproduction mechanism, or other type of printing mechanism.

With further reference to FIG. 1, the image forming device 100 may further include, along the media path, a media flipping mechanism 120 configured to flip the print media when an imaging job request designates double-sided or duplex imaging. The media flipping mechanism 120 can also be configured to allow the print media to pass through and exit the media flipping mechanism 120 without being flipped when an imaging job request designates single-sided imaging.

Once the print media exits the media flipping mechanism 120, the print media can be fed to a media registration mechanism 125 configured to align the print media in a relatively consistent position and orientation prior to imaging. A media registration mechanism will also be referred to as an alignment mechanism. In one embodiment, the media registration mechanism 125 is configured to align print media against one of two opposing registration walls depending on whether an imaging job request designates single-sided or duplex imaging.

With further reference to FIG. 1, the registered print media can then be advanced to a second image forming mechanism 130 where an image may be formed onto the print media. Optionally, if the print media was imaged in the first image forming mechanism 115, the print media can pass through the second image forming mechanism 130 without being imaged. The second image forming mechanism 130 may be embodied in a variety of different ways depending on the type of image forming device 100. For example, the second image forming mechanism 130 may include a laser imaging mechanism, an ink-jet mechanism, a thermal printing mechanism, a digital image reproduction mechanism, or other type of printing mechanism.

Once the print media is imaged by the second image forming mechanism 130, the print media can be moved along the media path to an output station 135. For example, the output station 135 can be one or more output trays or other devices from which a user can receive the imaged print media.

In one embodiment, the image forming device 100 can be configured to perform at least two different imaging operations. In one imaging operation, the image forming device 100 can be used for single-sided imaging of multiple sheets of print media. For example, when single sided imaging is designated, the first and second image forming mechanisms 115, 130 can be used to image the same side of alternate sheets of print media.

Figure 2A:
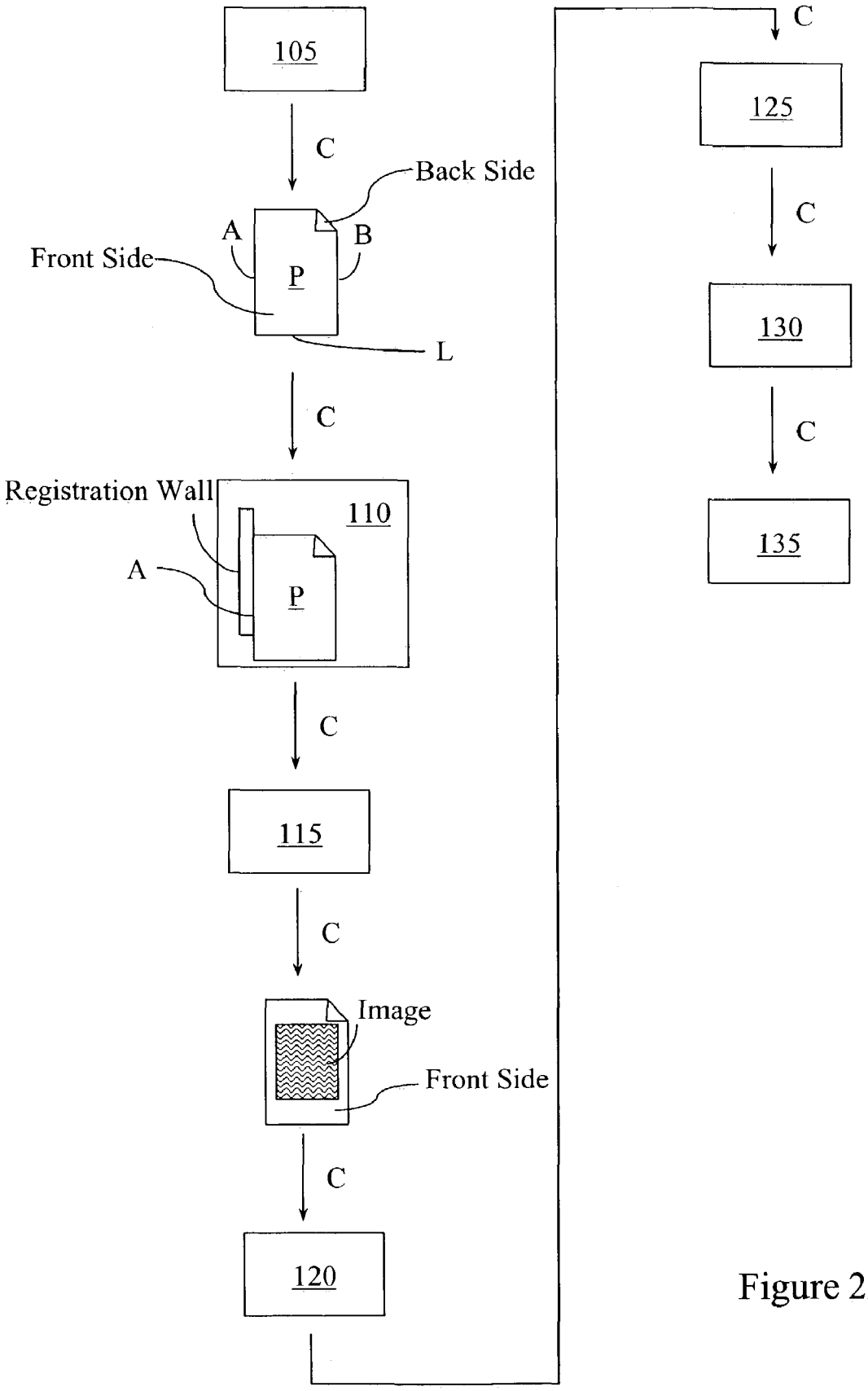
FIG. 2A illustrates one embodiment of a single-sided imaging sequence performed by the image forming device 100 on a first sheet of alternate sheets of print media.

Illustrated in FIG. 2A is one embodiment of a single-sided imaging sequence performed by the image forming device 100 on a first sheet of alternate sheets of print media. A sheet of print media P will be described with reference to a leading edge L, an edge A, an edge B, a front side, and a back side. The print media P can exit the media handling mechanism 105 and enter the media registration mechanism 110 in a configuration as shown in FIG. 2A along a media path represented by arrow C. In the media registration mechanism 110, the edge A of the print media P can be aligned against the registration wall as the print media P travels along the media path C. After the edge A of the print media P is aligned against the registration wall, the print media P can then be advanced to the first image forming mechanism 115 where an image can be formed on the front side of the print media P. After the image is formed on the front side of the print media P, the print media P can be passed through the media flipping mechanism 120 without being flipped. The print media P can then be passed through the remaining mechanisms to the output station 135.

Figure 2B:
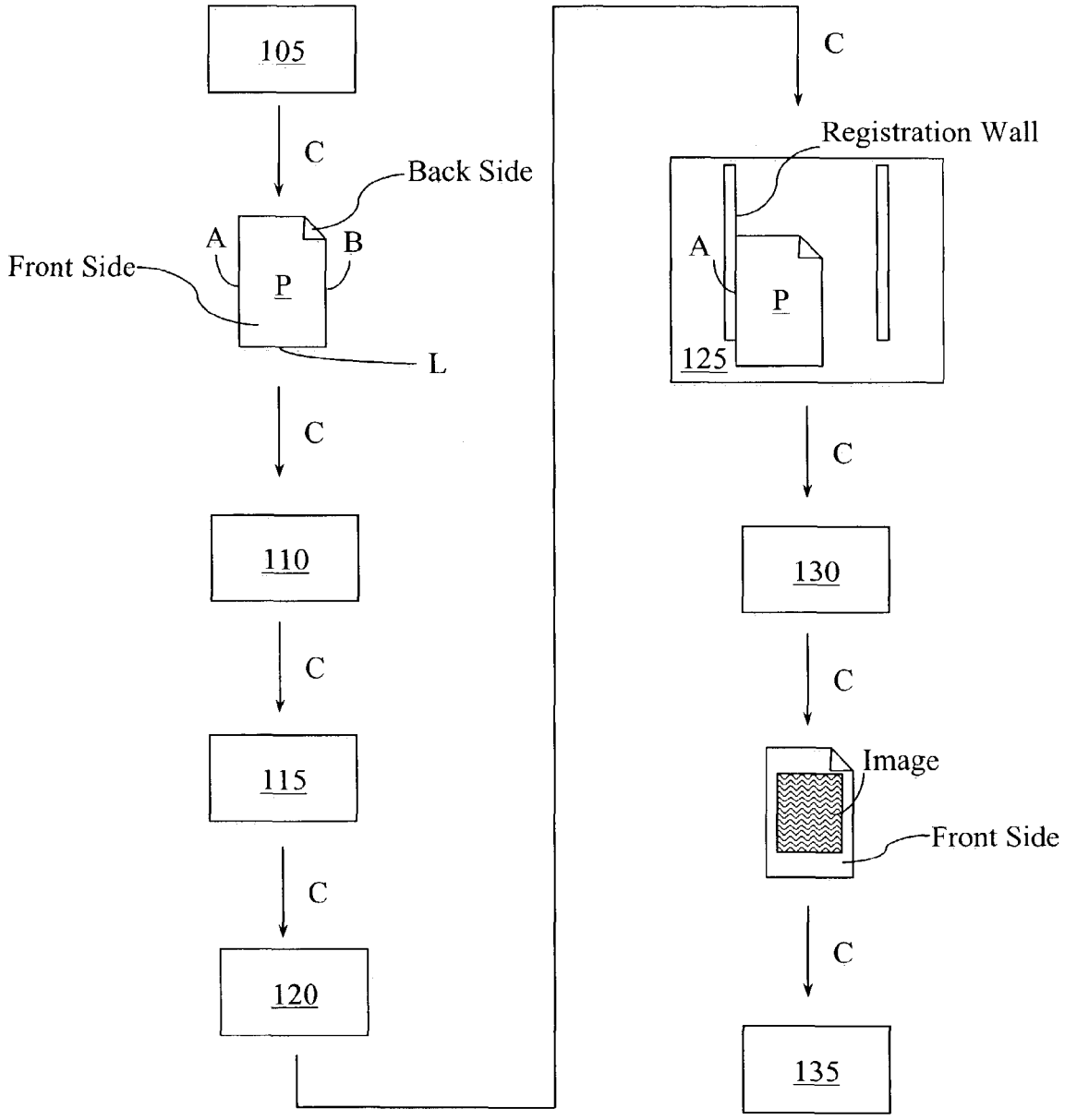
FIG. 2B illustrates one embodiment of a single-sided imaging sequence performed by the image forming device 100 on a second sheet of alternate sheets of print media.

Illustrated in FIG. 2B is one embodiment of a single-sided imaging sequence performed by the image forming device 100 on a second sheet of alternate sheets of print media P. The second sheet of print media P exits the media handling mechanism 105 in a configuration as shown in FIG. 2B along the media path C and passes through the media registration mechanism 110, the first imaging mechanism 115, and the media flipping mechanism 120. The second sheet of print media P can then be advanced to the media registration mechanism 125 where the edge A of the second sheet of print media P (which is the same side edge as the edge A of the first sheet of print media) can be aligned against a first registration wall.

Once the edge A of the second sheet of print media P is registered against the first registration wall, the second sheet of print media P can then be advanced to the second image forming mechanism 130 where an image can be formed on the front side of the second sheet of print media P (which is the same side as the front side of the first sheet of print media). The second sheet of print media P can then be advanced to the output station 135. In this manner, alignment of the same side edge of the print media P (e.g., the edge A in this embodiment) against the first registration wall can assure that the image is formed on the front side of the second sheet of print media P in the same position and orientation as the image formed on the front side of the first sheet of print media P.

In one embodiment, the operation of the image forming device 100 can be synchronized to image two sheets of print media in approximately one imaging cycle. For example, a sheet of print media can be fed to the second image forming mechanism 130 while the first image forming mechanism 115 is forming an image on a different sheet of print media. Likewise, a sheet of print media can be fed to the first image forming mechanism 115, while the second image forming mechanism 130 is forming an image on a different sheet of print media. Accordingly, the two sequences illustrated in FIGS. 2A and 2B can be synchronized such that both sequences can occur within one imaging cycle.

In another imaging operation, the image forming device 100 can be used for duplex imaging. For example, when duplex imaging is designated, the first image forming mechanism 115 can form an image on a front side of a sheet of print media and the second image forming mechanism 130 can form an image on a back side of the same sheet of print media (opposite the first side).

Figure 2C:
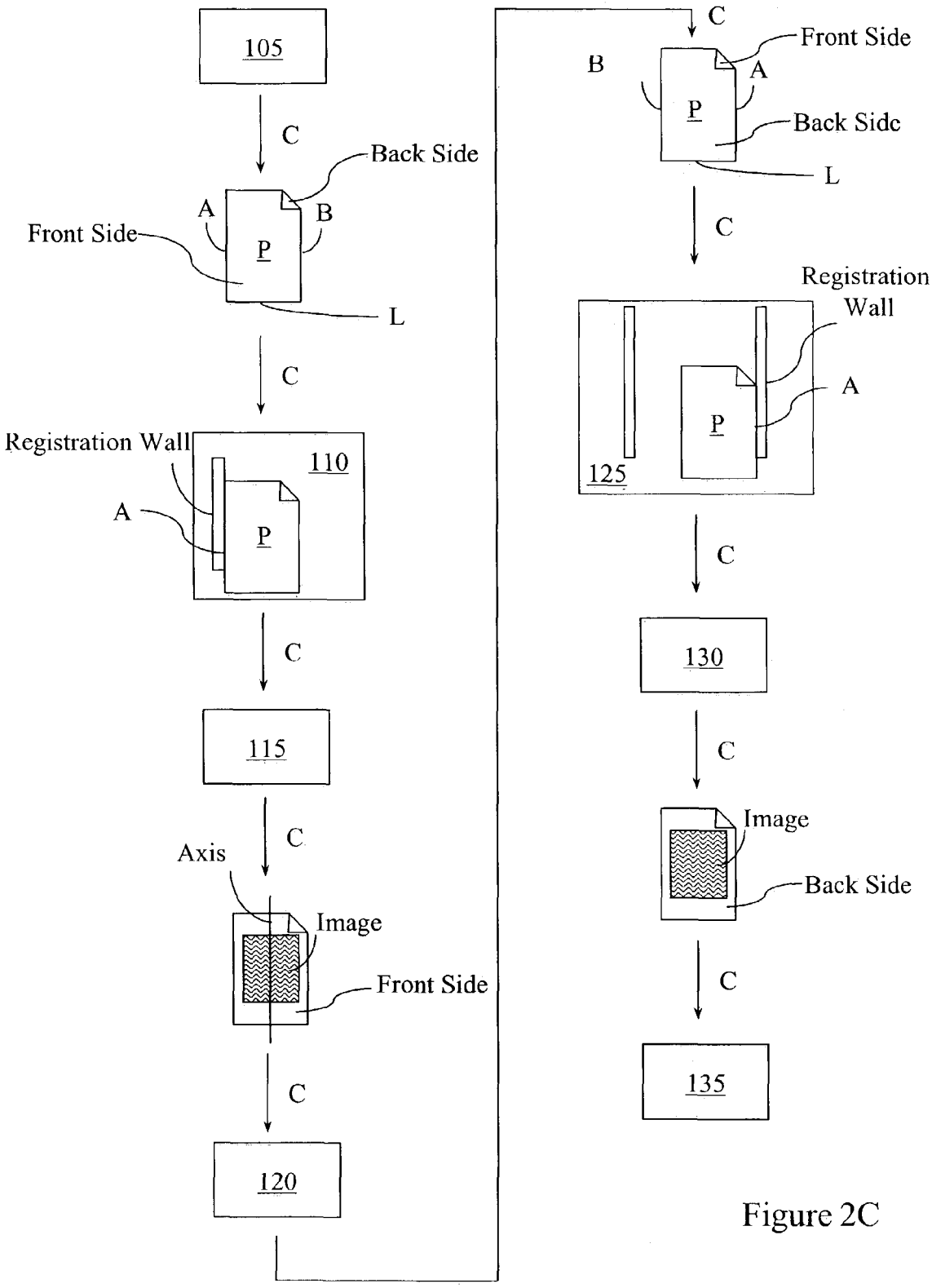
FIG. 2C illustrates one embodiment of a duplex imaging sequence performed by the image forming device 100.

Illustrated in FIG. 2C is one embodiment of a duplex imaging sequence performed by the image forming device 100. Once again, a sheet of print media P will be described with reference to a leading edge L, an edge A, an edge B, a front side, and a back side. The print media P can exit the media handling mechanism 105 and enter the media registration mechanism 110 in a configuration as shown in FIG. 2C along a media path represented by arrow C. In the media registration mechanism 110, the edge A of the print media P can be aligned against the registration wall as the print media P travels along the media path C. After the edge A of the print media P is registered against the registration wall, the print media P is then advanced to the first image forming mechanism 115 where an image is formed on the front side of the print media P.

The print media P can then be advanced to the media flipping mechanism 120 to flip the print media P in a manner such that the edge A and the edge B of the print media P are reversed. For example, the media flipping mechanism 120 can rotate the print media P about an axis that extends through the center of the print media P in a direction substantially parallel to the media path C. Accordingly, after the print media P has been flipped, the leading edge L of the print media P remains as the leading edge L, the edge A and the edge B are reversed, and the back side is flipped and exposed to be imaged upon. Of course, the flipping mechanism 120 can be configured to flip the print media in other ways.

With further reference to FIG. 2C, after the print media P is flipped, the print media P can be advanced to the media registration mechanism 125. In one embodiment, the media registration mechanism 125 can be configured to be selectively configurable to align print media in multiple ways. For example, the media registration mechanism 125 can include two opposing registration walls on either side of the media path C. The print media P can then be caused to align against one registration wall or the other in accordance with a selected alignment configuration.

For example, in the media registration mechanism 125, the edge A of the print media P (which is the same side edge of the print media P that was aligned against the first registration wall in the media registration mechanism 110) can be aligned against a second registration wall, opposing the first registration. The print media P can then be advanced to the second image forming mechanism 130 where an image is formed on the back side of the print media P. In this manner, alignment of the same edge of the print media P (e.g., the edge A in this embodiment) against the second registration wall assures that the image formed on the back side of the print media P is positioned and oriented properly with respect to the image formed on the front side of the print media P. For example, when a border is imaged on the front side of the print media P, the second image forming mechanism 130 can form another border on the back side of the print media P that is substantially aligned with the border on the front side of the print media P. The borders can be substantially aligned with each other because the same edge of the print media was used to align the print media P prior to the imaging on both sides of the print media P.

Figure 3A:
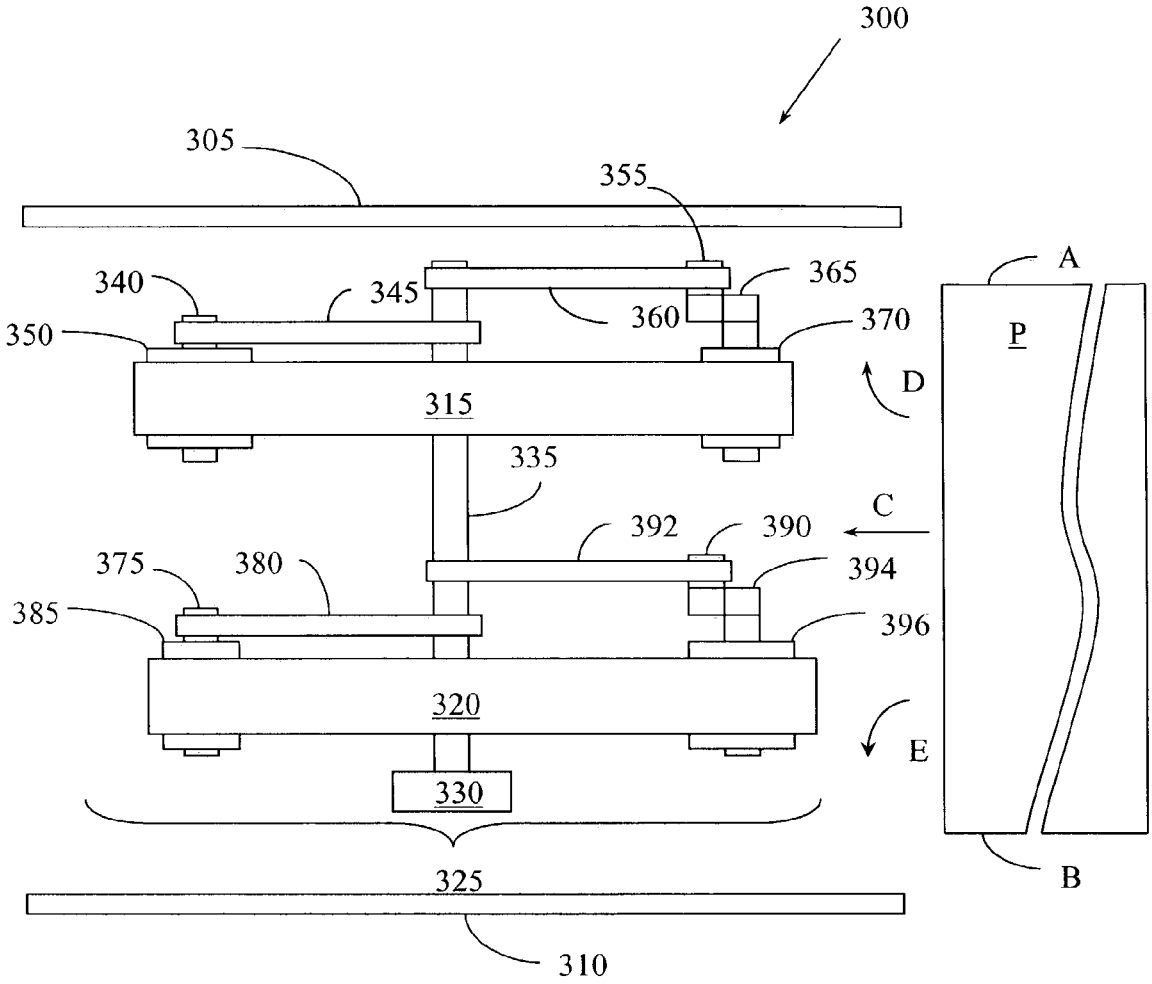
FIG. 3A is a top view of one embodiment of a media registration mechanism 300.

Illustrated in FIG. 3A is a top view of one embodiment of a media registration mechanism 300 that can be dynamically configured to align print media P in two directions. As shown in FIG. 3A, a sheet of print media P will be described with reference to a leading edge, an edge A, and an edge B. In one embodiment, the media registration mechanism 300 can include a first registration wall 305 and a second registration wall 310. A registration wall will also be referred to as an alignment wall or a fence. The first registration wall 305 can be configured to assist in the process of positioning and orienting print media P prior to imaging when the print media P is designated for single-sided imaging. The second registration wall 310 can be configured to assist in the process of positioning and orienting print media P prior to imaging when the print media P is designated for duplex imaging. Of course, it will be appreciated that the first and second registration walls 305, 310 can be configured in different ways. By aligning the print media P, an image can be formed at a generally consistent location on the print media P relative to the first or second registration walls 305, 310, respectively, depending on which alignment direction the media registration mechanism 300 is selectively configured to.

With further reference to FIG. 3A, the media registration mechanism 300 can include a plurality of media carriers that each engage and move the print media P along a media path represented by arrow C. In one embodiment, the plurality of media carriers can include, for example, a first transport belt 315 and a second transport belt 320. It will be appreciated that any number of belts or other media carriers can be used to implement the media registration mechanism. Furthermore, it will be appreciated that other types of media carriers may be used instead of belts such as nipped rollers, a vacuum assisted belt, or an electrostatically charged web.

In one embodiment, the first and second belts 315, 320 can be positioned substantially parallel to each other (e.g., side-by-side) and substantially parallel to and between the first and second registration walls 305, 310. The first and second belts 315, 320 can be configured to travel in a closed loop path such that the belts 315, 320 can move the print media P along the media path C.

In one embodiment, the first and second belts 315, 320, individually, act as conveyers that can move the print media P in a linear direction substantially parallel to the media path C. However, in combination, the first and second belts 315, 320 are configured to shift or rotate the print media P toward a selected one of the registration walls 305, 310 when the print media P simultaneously engages the first and second belts 315, 320.

For example, the first and second belts 315, 320 can be configured to be selectively driven at different speeds in at least two different speed ratios. Thus, when the print media P simultaneously engages both the belts 315, 320, the belts can selectively steer the print media P towards the first registration wall 305 or the second registration wall 310 depending on their relative speeds. In general, to steer the print media toward a selected registration wall, belts that are positioned closer to the selected registration wall are driven at a slower speed than belts positioned further away. In this manner, the media registration mechanism 300 can be dynamically configurable in two alignment states in order to selectively align the print media P along one of the registration walls 305, 310.

In a first alignment state, the media registration mechanism 300 can be configured to drive the first belt 315 at a speed less than the speed of the second belt 320 such that a speed ratio between the speed of the first belt 315 and the speed of the second belt 320 is less than 1:1. When the first and second belts 315, 320 are configured to be driven at such a speed ratio, the first and second belts 315, 320, upon concurrently engaging the print media P, cause the print media P to rotate towards the first registration wall 305 in the direction, represented by arrow D, as the print media P moves along the media path C. The print media P can continue to rotate towards the first registration wall 305 until the edge A of the print media P contacts and is substantially aligned against the first registration wall 305. In other words, because of the difference in relative speeds between the first and second belts 315, 320 (where the first belt 315 is operated at a speed slower than the second belt 320), the print media P is skewed towards the first registration wall 305.

In a second alignment state, the speeds of the first and second belts 315, 320 may be reversed or changed such that the speed of the first belt 315 is greater than the speed of the second belt 320. For example, the belts are driven at a second speed ratio where the speed of the first belt 315 and the speed of the second belt 320 have a ratio greater than 1:1. When the first and second belts 315, 320 are configured to be driven at the second speed ratio, the first and second belts 315, 320, upon concurrently engaging the print media P, cause the print media P to rotate towards the second registration wall 310 in the direction, represented by arrow E, as the print media P moves along the media path C. The print media P can continue to rotate towards the second registration wall 305 until edge B of the print media P contacts and is substantially aligned against the second registration wall 310.

To selectively drive the first and second belts 315, 320 at different speeds in at least two different speed ratios, the media registration mechanism 300 may further include drive means coupled to the first and second belts 315, 320. In one embodiment, the drive means includes a drive mechanism 325. The drive mechanism 325 can include a motor 330 and a drive shaft 335 coupled to the motor 330. In one embodiment, the motor 330 can be a bi-directional motor configured to be selectively rotated in a clockwise or counterclockwise direction which, as described further below, will cause the speeds of the first and second belts 315, 320 to change. For purposes of simplicity and establishing a reference direction in the drawings, the clockwise direction is a direction opposite the media path A and the counterclockwise direction is the same direction as the media path A.

In one embodiment, the drive shaft 335 can be coupled to each belt via a coupling mechanism. In general, each coupling mechanism can include multiple rollers, shafts, and drive belts configured to selectively change the speeds of each belt. For example, the first belt 315 can be coupled to the drive shaft 335 via a first coupling mechanism. The first coupling mechanism can include a first shaft 340 coupled to the drive shaft via a first drive belt 345. The first shaft 340 can include a downstream one-directional roller 350 having a radius. The roller 350 will be referred to as a downstream roller since it is downstream along the media path C relative to an upstream roller 370. The downstream one-directional roller 350 can be configured to be driven when the first shaft 340 is operated in a counterclockwise direction and idled when the first shaft 340 is operated in a clockwise direction. The downstream one-directional roller 350 is drivingly engaged to the first belt 315 such that the first belt 315 is driven when the downstream one-directional roller 350 is driven. Obviously, the downstream one-directional roller 350 can be configured to be driven when the first shaft 340 is operated in a clockwise direction and idled when the first shaft 340 is operated in a counterclockwise direction. It will be appreciated that one-way clutches, one-directional ratchet-type couplings, or other mechanical components that allow, for example, only one direction of rotation may be used instead of one-directional rollers to achieve the same effect.

The first coupling mechanism can further include a first geared shaft 355 coupled to the drive shaft 335 via a third drive belt 360. The first geared shaft 355 can be engaged with a second geared shaft 365 to reverse the rotation of the second geared shaft 365 when the first geared shaft 355 is rotated. For example, when the drive shaft 335 is rotated in the clockwise direction, the first geared shaft 355 would rotate in the clockwise direction and the second geared shaft 365 would rotate in the counterclockwise direction. The second geared shaft 365 can include an upstream one-directional roller 370 having a radius that is less than the radius of the downstream one-directional roller 350. The upstream one-directional roller 370 can be configured to be driven when the second geared shaft 365 is operated in a counterclockwise direction and idled when the second geared shaft 365 is operated in a clockwise direction. The upstream one-directional roller 370 is drivingly engaged to the first belt 315 such that the first belt 315 is driven when the upstream one-directional roller 370 is driven. Obviously, the upstream one-directional roller 370 can be configured in an opposite manner as well depending on the configuration of the other rollers.

With further reference to FIG. 3A, the second belt 320 can be coupled to the drive shaft 335 via a second coupling mechanism. The second coupling mechanism can include a second shaft 375 coupled to the drive shaft 335 via a third drive belt 380. The second shaft 375 can include a downstream one-directional roller 385 having a radius. The downstream one-directional roller 385 can be configured to be driven when the second shaft 375 is operated in the counterclockwise direction and idled when the second shaft 375 is operated in the clockwise direction. The downstream one-directional roller 385 is drivingly engaged to the second belt 320 such that the second belt 320 is driven when the downstream one-directional roller 385 is driven. Obviously, the downstream one-directional roller 385 can be configured to be driven when the second shaft 375 is operated in a clockwise direction and idled when the second shaft 375 is operated in a counterclockwise direction.

The second coupling mechanism can further include a third geared shaft 390 coupled to the drive shaft 335 via a fourth drive belt 392. The third geared shaft 390 is engaged with a fourth geared shaft 394 to reverse the rotation of the fourth geared shaft 394 when the third geared shaft 390 is rotated. The fourth geared shaft 394 can include an upstream one-directional roller 396 having a radius that is greater than the radius of the downstream one-directional roller 385. The upstream one-directional roller 396 can be configured to be driven when the fourth geared shaft 394 is operated in the counterclockwise direction and idled when the fourth geared shaft 394 is operated in the clockwise direction. The upstream one-directional roller 396 is drivingly engaged to the second belt 320 such that the second belt 320 is driven when the upstream one-directional roller 396 is driven. Obviously, the upstream one-directional roller 396 can be configured in an opposite manner as well depending on the configuration of the other rollers.

Figure 3B:
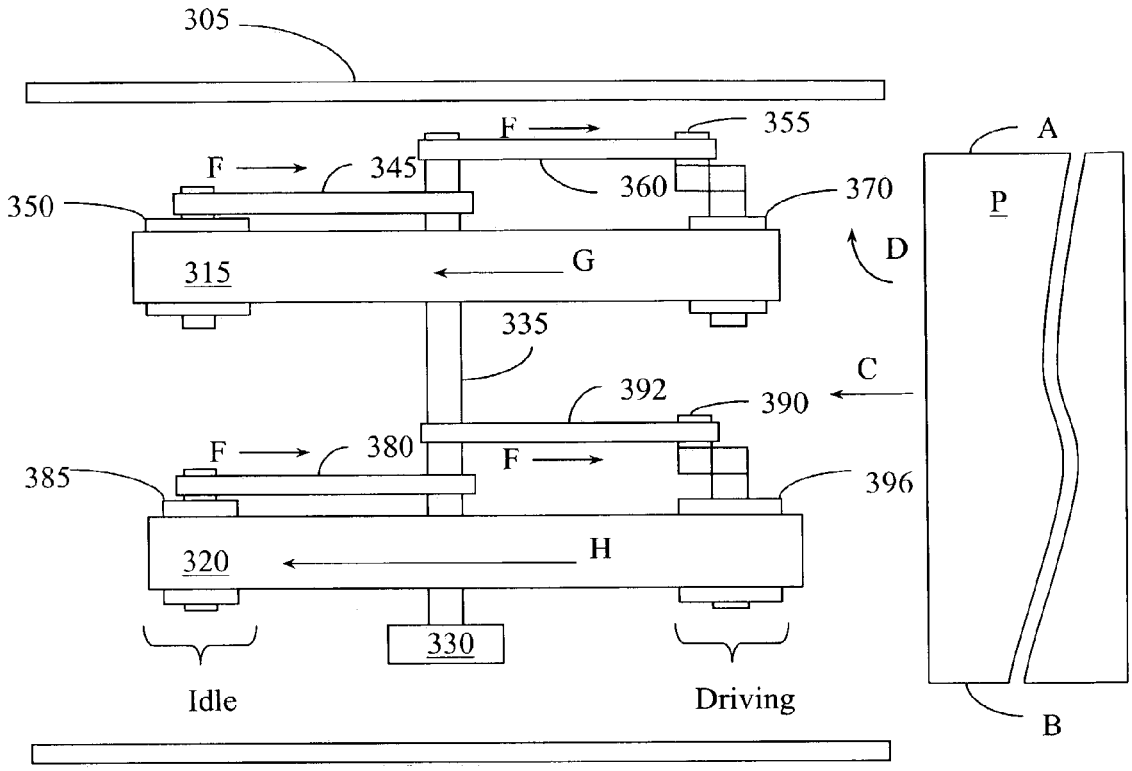
FIG. 3B illustrates one example of the relative speeds of the first and second belts 315, 320 and the directions of the drive belts when the drive mechanism 325 is configured to align the edge A of the print media P against the first registration wall 305.

In one embodiment, the drive mechanism 325 can be configured to cause the print media to align against the first registration wall 305. For example, FIG. 3B graphically illustrates the relative speeds of the first and second belts 315, 320 and the directions of the drive belts when the drive mechanism 325 is configured to cause edge A of the print media P to align against the first registration wall 305. In this example, the drive shaft 335 can be selectively rotated in the clockwise direction to cause the edge A of the print media P to align against the first registration wall 305. Obviously, the drive mechanism 325 can be configured to cause edge B of the print media P to align against the second registration wall 310 when the drive shaft is selectively driven in the counterclockwise direction.

When the drive shaft 335 is rotated in the clockwise direction, the first and third geared shafts 355, 390 are rotated in the clockwise direction via the third and fourth drive belts 360, 392, respectively, which travel in the direction represented by arrows F. The rotation of the first and third geared shafts 355, 390 in the clockwise direction causes the second and fourth geared shafts 365, 394 to rotate in the counterclockwise direction. Since the upstream one-directional rollers 370, 396 are configured to be operated in the counterclockwise direction, the upstream one-directional rollers 370, 396 are driven by the second and fourth geared shafts 365, 394, respectively. Accordingly, in this embodiment, the upstream one-directional rollers 370, 396 are the "driving" rollers that dictate the speeds of the first and second belts 315, 320, respectively, while the downstream one-directional rollers 350, 385 are the "idle" rollers.

Simultaneously, when the drive shaft 335 is rotated in the counterclockwise direction, the first and second shafts 340, 375 are rotated in the counterclockwise direction via the first and second drive belts 345, 380, respectively, which also travel in the direction F. Since the downstream one-directional rollers 350, 385 are configured to be operated in the counterclockwise direction, the first and second shafts 340, 375 do not engage the downstream one-directional rollers 350, 365, respectively. Accordingly, the downstream one-directional rollers 350, 365 are not driven by the first and second shafts 340, 375 when the drive shaft 335 is rotated in the counterclockwise direction. It will be appreciated that the downstream one-directional rollers 350, 385 can still rotate in the counterclockwise direction even though the drive shaft 335 is rotated in the counterclockwise direction because the first and second belts 315, 320 are drivingly engaged with the downstream one-directional rollers 350, 385. However, as previously mentioned, the speeds of the first and second belts 315, 320 are dictated by the upstream one-directional rollers 370, 396, respectively, since they are the "driving" rollers in this example.

When the rear one-dimensional rollers 370, 396 are driven, the linear speeds of the first and second belts 315, 320 can be the product of the radius of the upstream one-dimensional rollers 370, 396, respectively, multiplied by the angular speed of the drive shaft 335. Accordingly, when the drive shaft 335 is driven at one angular speed, the first and second belts 315, 320 are driven at different linear speeds since the upstream one-dimensional rollers 370, 396, respectively, of the drive shaft 335 have different radii. Thus, when the drive shaft 335 is rotated in the clockwise direction, the speed of the first belt 315 (represented by arrow G) is less than the speed of the second belt 320 (represented by arrow H, which is longer than arrow G to illustrate the difference in speeds) because the radius of the upstream one-dimensional roller 370 is less than the radius of the upstream one-dimensional roller 396.

In one embodiment, a percentage difference between the speed of the first belt 315 and the second belt 320 can be proportional to the percentage difference between the radii of the rear one-directional rollers 370, 396. For example, if the radius of the upstream one-directional roller 370 is 5% less than the radius of the upstream one-directional roller 396, then the speed of the first belt 315 is 5% less than the speed of the second belt 320. In one embodiment, the radius of the upstream one-directional roller 370 is between about 1% and about 5% greater than the radius of the upstream one-directional roller 396. Of course, other desired percentage ratios can be used.

When print media P is carried by the first and second belts 315, 320, the slower belt (e.g., the first belt 315 in the above example) creates drag on a portion of the print media P relative to a portion of the print media P in contact with the faster belt (e.g., the second belt 320 in the above example). The difference in belt speeds causes the print media P to rotate towards the slower belt (e.g., the first belt 315) in the direction D. Thus, the print media P will move towards the first registration wall 305 causing edge A of the print media P to contact and substantially align against the first registration wall 305. In other words, when the first belt 315 is traveling at a speed less than the second belt 320, the print media P is steered towards the first registration wall 305 while the print media P continues to move along the media path C.

Figure 3C:
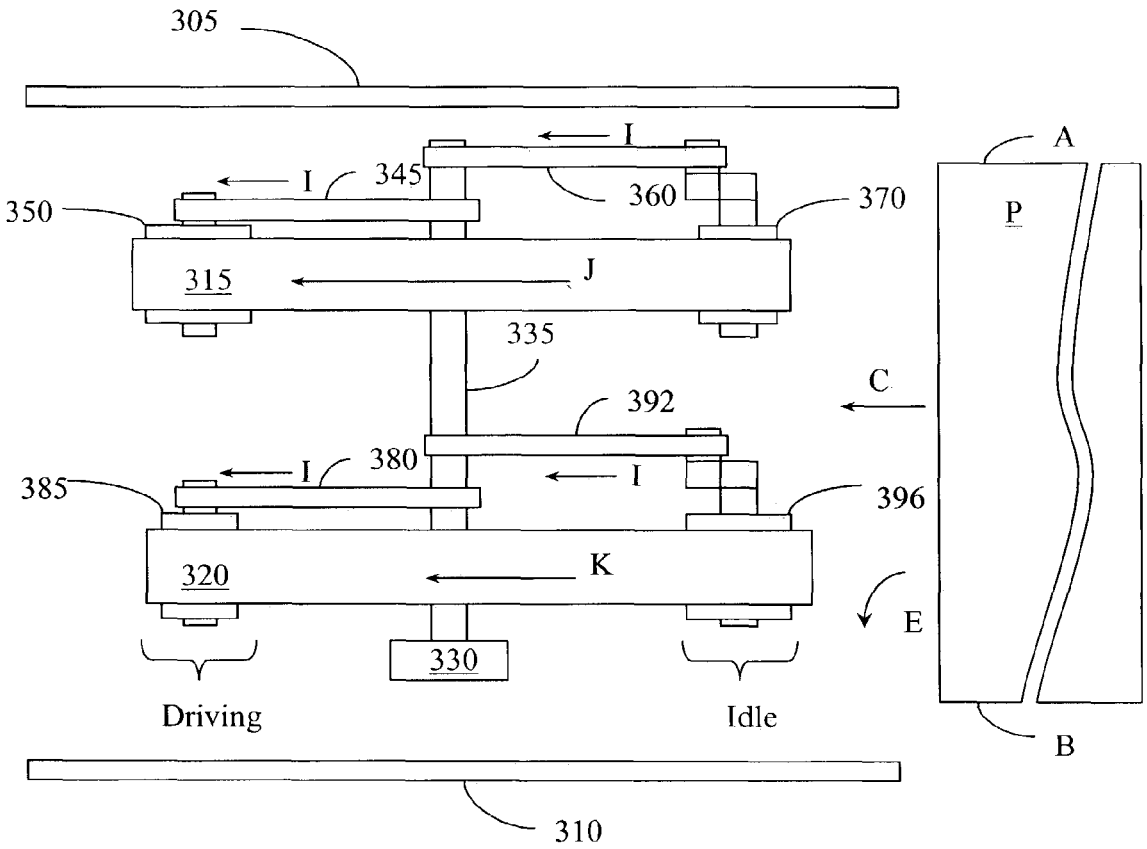
FIG. 3C illustrates one example of the relative speeds of the first and second belts 315, 320 and the directions of the drive belts when the drive mechanism 325 is configured to align the edge B of the print media P against the second registration wall 310.

With the above configuration, the drive mechanism 325 can be dynamically re-configured to cause the print media to align against the second registration wall 310. For example, FIG. 3C graphically illustrates the relative speeds of the first and second belts 315, 320 and the directions of the drive belts when the drive mechanism 325 is configured to cause the edge B of the print media P to align against the second registration wall 310. In this example, the rotation of the drive shaft 335 can be selectively reversed by the motor 330 (i.e., rotated in the counterclockwise direction) to cause the edge B of the print media P to align against the second registration wall 310.

When the drive shaft 335 is rotated in the counterclockwise direction, the first and second shafts 340, 375 are rotated in the counterclockwise direction via the first and second drive belts 345, 380, respectively, which travel in the direction represented by arrows I. Since the downstream one-directional rollers 350, 385 are configured to be operated in the counterclockwise direction, the downstream one-directional rollers 350, 385 are driven by the first and second shafts 340, 375, respectively. Accordingly, in this embodiment, the downstream one-directional rollers 350, 385 are the "driving" rollers that dictate the speeds of the first and second belts 315, 320, respectively, while the upstream one-directional rollers 370, 396 are the "idle" rollers.

Simultaneously, when the drive shaft 335 is rotated in the counterclockwise direction, the first and third geared shafts 355, 390 are rotated in the counterclockwise direction via the third and fourth drive belts 360, 392, respectively, which also travel in the direction I. The rotation of the first and third geared shafts 355, 390 in the counterclockwise direction causes the second and fourth geared shafts 365, 394 to rotate in the clockwise direction. Since the upstream one-directional rollers 370, 396 are configured to be operated in the counterclockwise direction, the first and second shafts 340, 375 do not engage the upstream one-directional rollers 370, 396, respectively. Accordingly, the upstream one-directional rollers 370, 396 are not driven when the drive shaft 335 is rotated in the counterclockwise direction. It will be appreciated that the upstream one-directional rollers 370, 396 can still rotate in the counterclockwise direction even though the drive shaft 335 is rotated in the counterclockwise direction because the first and second belts 315, 320 are drivingly engaged with the upstream one-directional rollers 370, 396. However, as previously mentioned, the speeds of the first and second belts 315, 320 are controlled in part by the downstream one-directional rollers 350, 385, respectively, since they are the "driving" rollers in this example.

In this example, the rotation of the drive shaft 335 can be selectively reversed by the motor 330 (e.g., rotated in the counterclockwise direction) such that the downstream one-directional rollers 350, 385 become the "driving" rollers, while the upstream one-directional rollers 370, 396 become the "idle" rollers. Accordingly, the speed of the first belt 315 (represented by arrow J) is greater than the speed of the second belt 320 (represented by arrow K, which is shorter than arrow J to illustrate the difference in speeds) because the diameter of the downstream one-dimensional roller 350 is greater than the diameter of the downstream one-dimensional roller 385.

When print media P is carried by the first and second belts 315, 320, the slower belt (e.g., the second belt 320 in the above example) creates drag on a portion of the print media P relative to a portion of the print media P in contact with the faster belt (e.g., the first belt 315 in the above example) The difference in belt speeds causes the print media P to rotate towards the slower belt (e.g., the second belt 320) in the direction E. Thus, the print media P will move towards the second registration wall 310 causing edge B of the print media P to contact and substantially align against the second registration wall 310.

Thus, the linear speeds of the first and second belts 315, 320 can be dynamically and selectively changes by reversing the "driving" rollers of each belt. If the "driving" roller is larger in diameter, the belt will travel faster than when a smaller diameter is used assuming the drive shaft 335 is maintained at a relatively constant speed. Once again, by configuring the first and second belts 315, 320 to travel at different relative speeds, the print media can be caused to rotate towards the slower belt.

In another embodiment, the drive means may include separate motors to independently and selectively drive each of the first and second belts 315, 320 at different speeds. It will be appreciated that other types of drive means may be used including any mechanical, electromechanical, electromagnetic components, or combinations thereof to selectively drive the first and second belts 315, 320 at different speeds.

Figure 4:
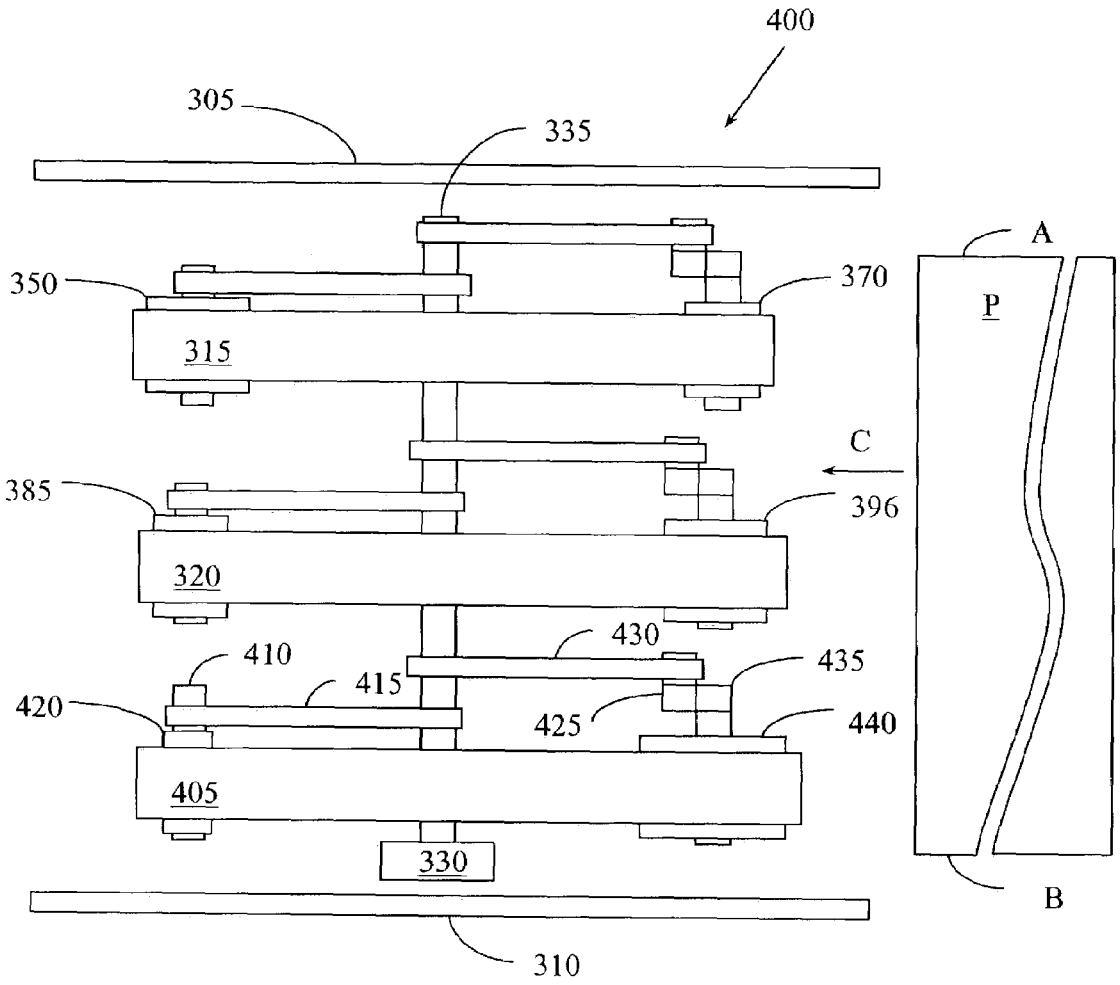
FIG. 4 is a top view of another embodiment of a media registration mechanism 400.

Illustrated in FIG. 4 is a top view of another embodiment of a media registration mechanism 400. Media registration mechanism 400 is similar in structure to and operates in a similar manner as media registration mechanism 300 illustrated in FIG. 3A. However, the media registration mechanism 400 includes a third media carrier such as a third belt 405. In one embodiment, the third belt 405 can be oriented substantially parallel to and positioned between the second registration wall 310 and the second belt 320.

The third belt 405 can be configured to engage the print media and move it relative to the first and second registration walls 305, 310 simultaneously with the first and second belts 315, 320. In one embodiment, the third belt 405 can be configured to move the print media P in a linear direction substantially parallel to the media path C and the first and second registration walls 305, 310.

In one embodiment, the first, second, and third belts 315, 320, 405 can be configured to be selectively driven at different speeds in order to selectively steer the print media P towards the first registration wall 305 or the second registration wall 310. For example, the first, second, and third belts 315, 320, 405 can be configured to be driven at different speeds such that the third belt 405 is driven at a speed greater than the second belt 320, which is driven at a speed greater than the first belt 315. This difference in belt speeds causes the print media P to rotate towards the first registration wall 305 when the print media P is carried along the media path C by the first, second, and third belts 315, 320, 405. Hence, the speed of each belt increases as the distance between each belt and the first registration wall 305.

In this embodiment, the first, second, and third belts 315, 320, 405 can be dynamically re-configured to change the speeds of the belts such that the third belt 405 is driven at a speed less than the second belt 320, which is driven at a speed less than the first belt 315. This difference in speeds can cause the print media P to rotate towards the second registration wall 310 when the print media P engages the first, second, and third belts 315, 320, 405. Thus, the speed of each belt increases as the distance between each belt and the second registration wall 310 increases. In another embodiment, the speeds of the outer belts (e.g., the first and third belts 315, 405) can be selectively changed when the rotation direction of the drive shaft 335 is reversed, while the speed of the inside belt (e.g., the second belt 320) can remain constant. To accomplish this, the upstream and downstream one-directional rollers (i.e., 385, 396) of the second belt 320 would have substantially the same radius.

In one embodiment, the media registration mechanism 400 can further include a third coupling mechanism coupled to the drive shaft 335 and the third belt 405 to selectively change the speeds of the third belt 405. The third coupling mechanism can include a third shaft 410 coupled to the drive shaft via a drive belt 415. The third shaft 410 can include a downstream one-directional roller 420 having a radius that is less than the other two downstream one-directional rollers 350, 385. The downstream one-directional roller 420 can be configured to be driven when the third shaft 410 is operated in a counterclockwise direction and idled when the third shaft 410 is operated in a clockwise direction. The downstream one-directional roller 420 is drivingly engaged to the third belt 405 such that the third belt 405 is driven when the downstream one-directional roller 420 is driven.

The third coupling mechanism can further include one geared shaft 425 coupled to the drive shaft 335 via another drive belt 430. The geared shaft 425 can be engaged with another geared shaft 435 to reverse the rotation of the geared shaft 435 when the geared shaft 425 is rotated. For example, when the drive shaft 335 is rotated in the clockwise direction, the geared shaft 425 would rotate in the clockwise direction and the geared shaft 435 would rotate in the counterclockwise direction. The geared shaft 435 can include an upstream one-directional roller 440 having a radius that is less than the other two upstream one-directional rollers 370, 396. The upstream one-directional roller 440 can be configured to be driven when the geared shaft 435 is operated in a counterclockwise direction and idled when the geared shaft 435 is operated in a clockwise direction. The upstream one-directional roller 440 is drivingly engaged to the third belt 405 such that the third belt 405 is driven when the upstream one-directional roller 440 is driven.

Figure 5:
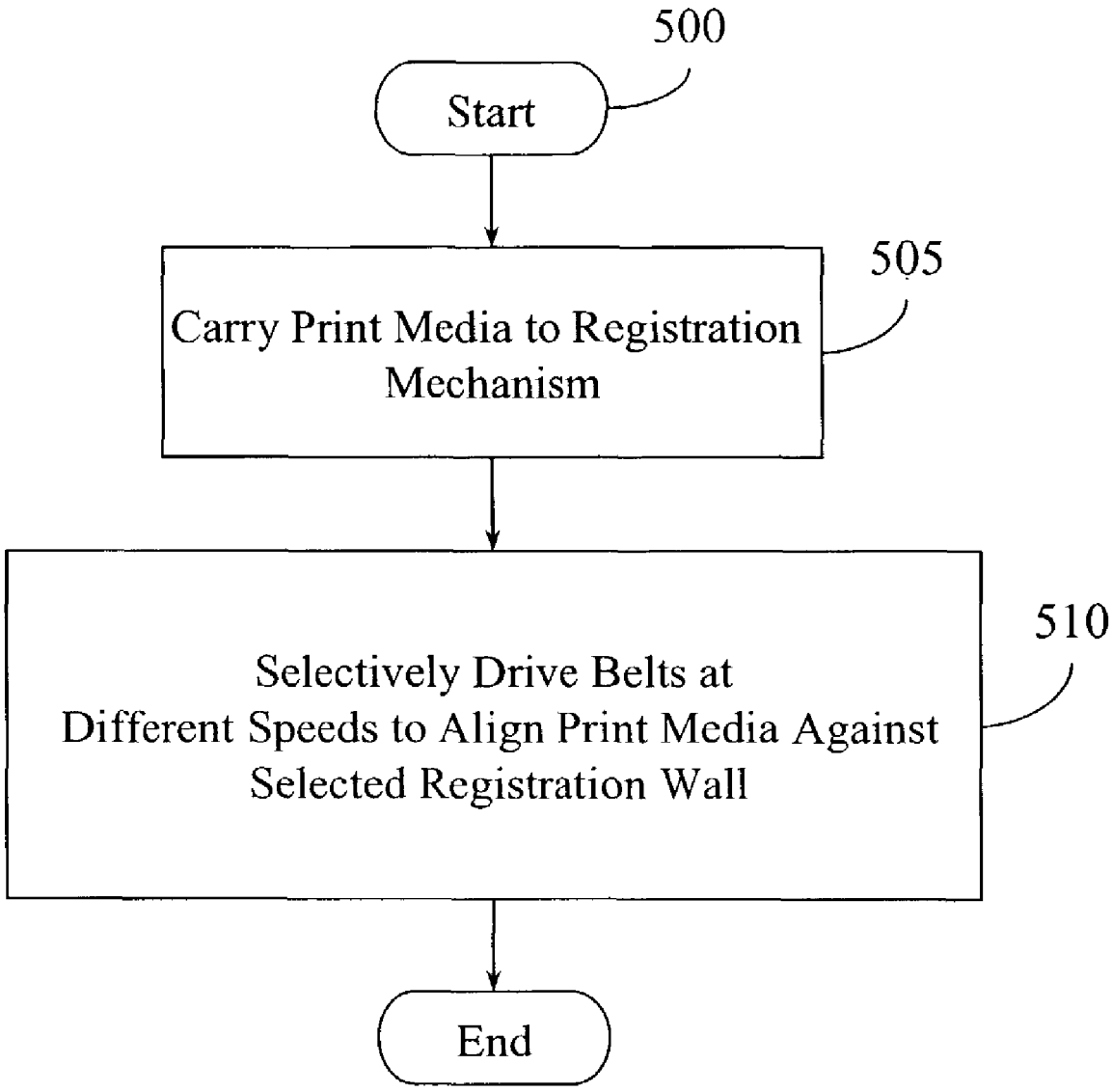
FIG. 5 illustrates one embodiment of a methodology for media registration.

Illustrated in FIG. 5 is one embodiment of a methodology associated with selectively registering print media. The illustrated elements denote "processing blocks" and represent functions and/or actions taken for registering print media. In one embodiment, the processing blocks may represent computer software instructions or groups of instructions that cause a computer or processor to perform an action(s) and/or to make decisions that control another device or machine to perform the processing. It will be appreciated that the methodology may involve dynamic and flexible processes such that the illustrated blocks can be performed in other sequences different than the one shown and/or blocks may be combined or, separated into multiple components. The foregoing applies to all methodologies described herein.

With reference to FIG. 5, the process 500 involves a print media registration process. The process 500 includes carrying print media along a media path to a registration mechanism having two parallel registration walls (block 505). The registration mechanism can be configured with multiple conveyor belts positioned between the two registration walls.

To align the print media substantially against a selected registration wall, the multiple belts can be selectively driven at different speeds such that the speeds of the multiple belts decrease towards the selected registration wall (block 510). Accordingly, the net effect of driving the multiple belts at different speeds causes the print media to skew towards and substantially align against the selected registration wall while still moving along the media path. Optionally, to align the print media substantially against the other registration wall, the speeds of the multiple belts can be selectively reversed or changed such that the speeds of the multiple belts decrease towards the other registration wall. Accordingly, the net effect of driving the multiple belts at different speeds causes the print media to skew towards and substantially align against the other registration wall while still moving along the media path.

Illustrated in FIGS. 6A–6E is one embodiment of an aligning sequence using the media registration mechanism 400 illustrated in FIG. 4. The sequence shows an example of aligning the print media substantially against the first registration wall 305. As previously mentioned, the media registration mechanism 400 includes the first and second registration walls 305, 310 and the first, second, and third belts 315, 320, 405 (hereinafter collectively referred to as "the belts"). The belts can be selectively driven at different speeds where the speeds of the belts decrease towards a selected registration wall (e.g., the first registration wall 305 in this embodiment).

Figure 6A:
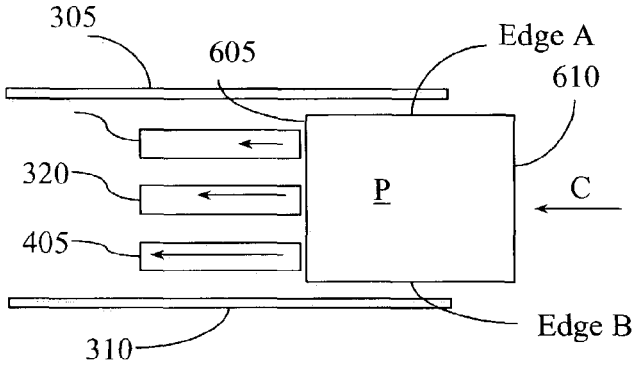
FIGS. 6A–6E illustrate one embodiment of a media registration sequence when aligning print media substantially against the first registration wall 305.

As shown in FIG. 6A, a sheet of print media P, having a leading edge 605, an edge A, an edge B, and a trailing edge 610, is carried along a media path C. In one embodiment, the print media P can be oriented such that the leading edge 605 of the print media P is substantially perpendicular to the first and second registration walls 305, 310 and the edges A and B are substantially parallel to the first and second registration walls 305, 310.

Figure 6D:
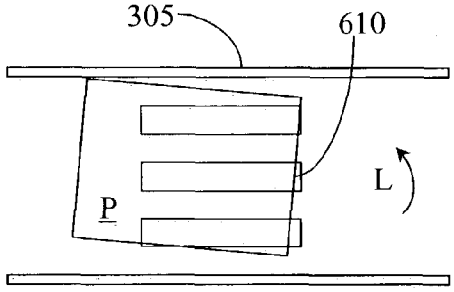
Figure 6B:
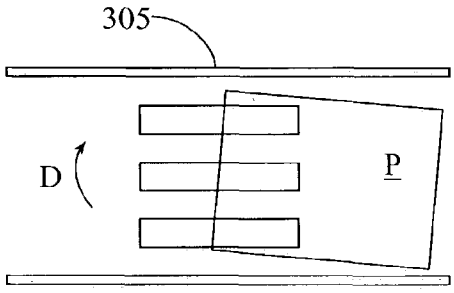

As shown in FIG. 6B, once the print media P comes into contact with the belts, the belts engage different portions of the print media P and simultaneously move the different portions of the print media P at different speeds along the media path C. The speeds of the belts decrease for a belt positioned closer to the first registration wall 305. One effect of simultaneously moving the different portions of the print media P at different speeds causes the print media P to rotate towards the first registration wall 305, in the direction D, while still moving along the media path C.

Figure 6E:
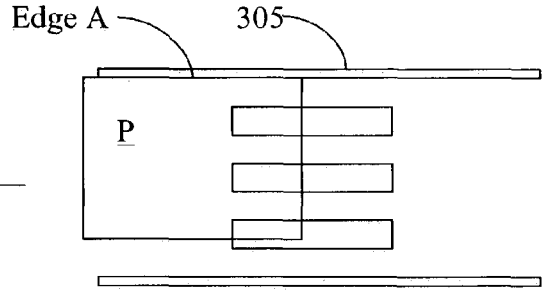
Figure 6C:
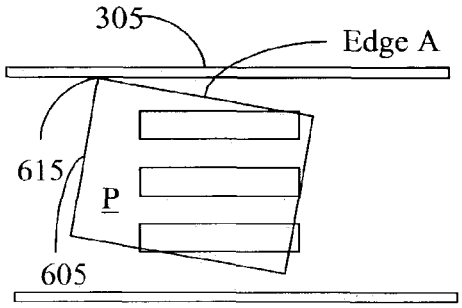

As shown in FIG. 6C, the print media P continues to rotate until one corner 615 of the print media P (i.e., meeting of the leading edge 605 and the edge B) comes into contact with the first registration wall 305. As shown in FIG. 6D, once the corner 615 of the print media P comes into contact with the first registration wall 305, the belts continue to move and try to rotate the print media P thereby creating additional friction between the belts and the print media P. The friction between the belts and the print media P creates a moment, represented by arrow L, that is induced about the point of contact with the first registration wall 305. The moment causes the trailing edge 610 of the print media P to rotate towards the first registration wall 305. As shown in FIG. 6E, the print media rotates towards the first registration wall 305 until the edge A of the print media P is in contact with and is substantially aligned against the first registration wall 305. Additional sheets of print media would also be similarly aligned.

Illustrated in FIGS. 7A–7E is one embodiment of an aligning sequence using the media registration mechanism 400 illustrated in FIG. 4. The sequence shows an example of aligning print media substantially against the second registration wall 310. As previously mentioned, the media registration mechanism 400 includes the first and second registration walls 305, 310 and the first, second, and third belts 315, 320, 405 (hereinafter collectively referred to as "the belts"). The belts can be selectively driven at different speeds where the speeds of the belts decrease towards a selected registration wall (e.g., the second registration wall 310 in this embodiment).

Figure 7A:
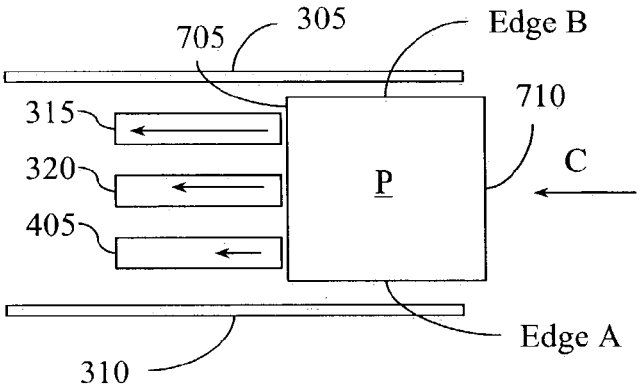
FIGS. 7A–7E illustrate one embodiment of a media registration sequence when aligning print media substantially against the second registration wall 310.
Figure 7D:
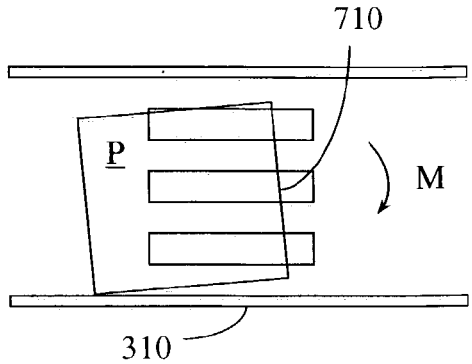

As shown in FIG. 7A, a sheet of print media P, having a leading edge 705, an edge A, an edge B, and a trailing edge 710, is carried along a media path C. In one embodiment, the print media P can be oriented such that the leading edge 705 of the print media P is substantially perpendicular to the first and second registration walls 305, 310 and the edges A and B are substantially parallel to the first and second registration walls 305, 310.

Figure 7B:
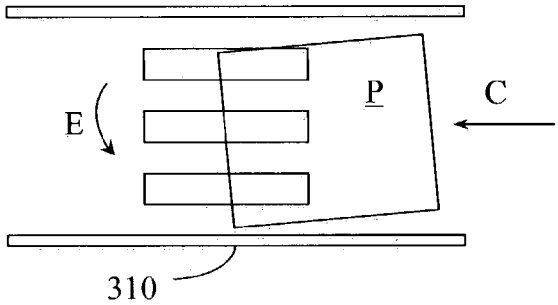

As shown in FIG. 7B, once the print media P comes into contact with the belts, the belts engage different portions of the print media P and simultaneously move the different portions of the print media P at different speeds along the media path C. The speeds of the belts decrease for a belt positioned closer to the second registration wall 310. One effect of simultaneously moving the different portions of the print media P at different speeds causes the print media P to rotate towards the second registration wall 310, in the direction represented by arrow E, while still moving along the media path C.

Figure 7E:
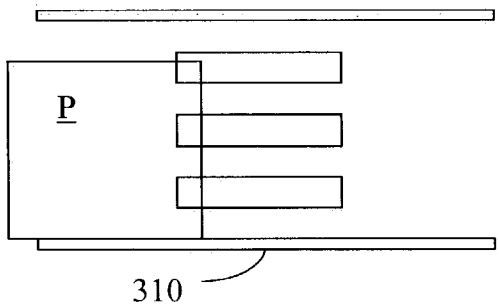
Figure 7C:
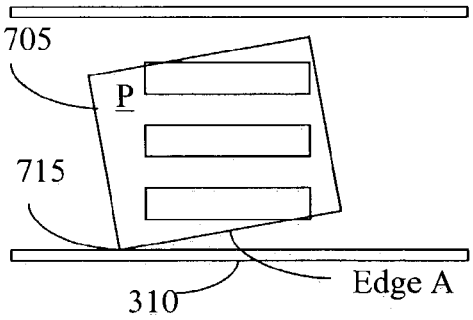

As shown in FIG. 7C, the print media P continues to rotate until one corner 715 of the print media P (e.g., meeting of the leading edge 705 and the edge A) comes into contact with the second registration wall 310. As shown in FIG. 6D, once the corner 715 of the print media P comes into contact with the second registration wall 310, the belts continue to move and try to rotate the print media P thereby creating additional friction between the belts and the print media P. The friction between the belts and the print media P creates a moment, represented by arrow M, that is induced about the point of contact with the second registration wall 310. The moment causes the trailing edge 710 of the print media P to rotate towards the second registration wall 310. As shown in FIG. 7E, the print media rotates towards the second registration wall 310 until the edge A of the print media P is in contact with and is substantially aligned against the second registration wall 310. Additional sheets of print media would also be similarly aligned.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A media registration mechanism for aligning print media, the mechanism comprising:

first and second registration walls;

a plurality of media carriers for moving the print media relative to the first and second registration walls, the plurality of media carriers oriented substantially parallel to each other and positioned between the first and second registration walls; and the media registration mechanism being configured to selectively drive the plurality of media carriers at different speeds in order to selectively steer the print media towards either the first or second registration wall to substantially align the print media against the first or second registration wall.

2. The mechanism of claim 1 wherein the plurality of media carriers are orientated substantially parallel to the two registration walls.

3. The mechanism of claim 1 wherein the plurality of media carriers include a plurality of belts.

4. The mechanism of claim 1 wherein the plurality of media carriers include at least a first belt and a second belt, the first belt positioned adjacent to the first registration wall and the second belt being positioned adjacent to the second registration wall.

5. The mechanism of claim 4 wherein the print media is steered towards the first registration wall when the speed of the second belt is greater than the speed of the first belt.

6. The mechanism of claim 4 wherein the print media is steered towards the second registration wall when the speed of the first belt is greater than the speed of the second belt.

7. The mechanism of claim 4 further comprising drive means coupled to the first and second belts to selectively drive the plurality of first and second belts at different speeds.

8. The mechanism of claim 7 wherein the drive means includes a drive mechanism coupled to the plurality of first and second belts.

9. The mechanism of claim 8 wherein the drive mechanism includes a bi-directional motor configured to be selectively rotated in a clockwise or counterclockwise direction.

10. The mechanism of claim 9 wherein the drive mechanism comprises a drive shaft coupled to the motor, the drive shaft being coupled to first and second coupling mechanisms configured to drive the first and second belts, respectively.

11. The mechanism of claim 7 wherein the drive means includes a first motor coupled to the first belt and a second motor coupled to the second belt.

12. A mechanism for aligning print media in an image forming device, the mechanism comprising:

first and second alignment walls;

first and second media carriers for moving print media in a direction substantially parallel to the first and second alignment walls, the first and second media carriers positioned side-by-side to each other and between the first and second alignment walls; and a drive mechanism coupled to the first and second media carriers, the drive mechanism being selectively configurable to drive the first and second media carriers at a first speed ratio to cause the print media to rotate towards and substantially aligns with the second alignment wall, the drive mechanism being reconfigurable to drive the first and second media carriers at a second speed ratio to cause the print media to rotate towards and substantially align with the first alignment wall.

13. The mechanism of claim 12 wherein the first media carrier is positioned between the first alignment wall and the second media carrier, and the second media carrier is positioned between the first media carrier and the second alignment wall.

14. The mechanism of claim 13 wherein the first speed ratio is greater than 1:1 such that the speed of the first belt is greater than the speed of the second belt.

15. The mechanism of claim 13 wherein the second speed ratio is less than 1:1 such that the speed of the second belt is greater than the speed of the first belt.

16. The mechanism of claim 12 wherein the first media carrier, the second media carrier and the first and second alignment walls are substantially parallel to each other.

17. The mechanism of claim 12 wherein the first and second media carriers include at least one belt for moving the print media in a linear direction.

18. The mechanism of claim 12 further including at least a third media carrier positioned between the first and second media carriers.

19. An image forming device comprising:

a media path configured to carry print media through the image forming device;

an alignment mechanism including a plurality of alignment walls, the alignment mechanism being capable of aligning the print media against a selected alignment wall from the plurality of alignment walls as the print media is carried along the media path; and an image forming mechanism configured to form an image on the aligned print media received from the alignment mechanism.

20. The image forming device of claim 19 wherein the plurality of alignment walls include first and second alignment walls positioned parallel to each other and parallel to the media path such that the print media is carried between the first and second alignment walls.

21. The image forming device of claim 19 wherein the alignment mechanism includes a means for selectively operating the plurality of belts at different speeds to cause the print media to rotate towards the selected alignment wall.

22. The image forming device of claim 21 wherein the speed of each belt increases as the distance between each belt and the selected alignment wall increases.

23. The image forming device of claim 19 wherein the alignment mechanism includes a plurality of belts each being configured to move the print media in a linear direction along the media path, the plurality of belts being positioned parallel to and between the first and second alignment walls.

24. An image forming device comprising:

a media registration mechanism including:

first and second registration fences;

first and second media carriers for moving print media along a media path in a direction substantially parallel to the first and second fences, the first and second media carriers positioned adjacent to each other and between the first and second fences such that the first media carrier is adjacent the first fence and the second media carrier is adjacent the second fence;

the first and second media carriers, upon concurrently engaging the print media, configured to steer the print media towards the first fence until an edge of the print media is substantially aligned against the first fence when the second media carrier is operated at a speed greater than the first media carrier; and the first and second media carriers, upon concurrently engaging the print media, configured to steer the print media towards the second fence until an opposite edge of the print media is substantially aligned against the second fence when the speeds of the first and second media carriers are reversed such that the first media carrier is operated at a speed greater than the second media carrier.

25. The device of claim 24 wherein the first and second media carriers are configured to steer the print media towards the first fence until the edge of the print media is substantially aligned against the first fence when the print media is designated for single-sided imaging, and wherein the first and second media carriers are configured to steer the print media towards the second fence until the opposite edge of the print media is substantially aligned against the second fence when the print media is designated for duplex imaging.

26. The device of claim 25 further comprising a media flipping mechanism configured to rotate the print media about an axis that is parallel to the media path when the print media is designated for duplex imaging, the media flipping mechanism positioned upstream from the media registration mechanism.

27. The device of claim 26 further comprising a second image forming mechanism wherein the media registration mechanism is positioned between the first image forming mechanism and the second image forming mechanism along the media path.

28. The device of claim 24 further comprising drive means coupled to the first and second media carriers for selectively driving the first and second media carriers at different relative speeds.

29. A method of registering print media in an image forming device including a registration mechanism, the registration mechanism including opposing first and second registration walls and, a plurality of media carriers positioned between the first and second registration walls where the plurality of media carriers are configured to move the print media in a linear direction along a media path relative to the first and second registration walls, the method comprising:

carrying the print media to the registration mechanism such that the plurality of media carriers engage the print media; and selectively driving the plurality of media carriers at different speeds to selectively cause the print media to skew towards and substantially align an edge of the print media against the first or second registration wall.

30. The method of claim 29 further including the step of advancing the print media to an image forming mechanism once the print media has been registered.

31. The method of claim 29 wherein the print media is skewed towards the second registration wall when a first media carrier of the plurality of media carriers is driven at a speed greater than a second media carrier of the plurality of media carriers.

32. The method of claim 29 wherein the selectively driving includes selectively changing a speed of one or more of the plurality of media carriers.

33. The method of claim 29 further including, prior to the carrying step:

aligning the print media along an alignment wall;

forming an image on the print media; and carrying the print media to the registration mechanism.

34. A method of registering print media in an image forming device, the method comprising:

carrying the print media between first and second registration walls with a plurality of media carriers; and selectively driving one or more of the plurality of media carriers at different speeds to selectively cause the print media to skew towards and substantially align an edge of the print media against the first or second registration wall.

* * * * *